United States Patent [19]

Legler et al.

[11] 4,020,604

[45] May 3, 1977

[54] DIVIDER SCREEN ASSEMBLY

[75] Inventors: George Legler, Kirkland, Canada; Hans Hostettler, Plattsburgh, N.Y.; Jean-Pierre Lacoste, Montreal; Friedrich Schwab, Montreal North, both of Canada

[73] Assignee: Precision Mfg. Inc. - Fabrication, St. Laurent, Canada

[22] Filed: Aug. 18, 1975

[21] Appl. No.: 605,524

[30] Foreign Application Priority Data

Nov. 20, 1974 Canada ..... 214213

[52] U.S. Cl. ..... 52/65; 52/70; 52/221; 52/494; 160/351

[51] Int. Cl.[2] ..... E04B 1/346

[58] Field of Search ..... 52/70, 71, 65, 221, 52/241, 282, 494; 160/135, 351

[56] References Cited

UNITED STATES PATENTS

| | | | |
|---|---|---|---|
| 3,559,352 | 2/1971 | Magnuson | 52/65 X |
| 3,762,116 | 10/1973 | Anderson et al. | 160/135 X |
| 3,766,959 | 10/1973 | Himsl | 160/135 |
| 3,889,736 | 6/1975 | Ficks | 160/135 |
| 3,913,656 | 10/1975 | Guyer | 160/135 |

FOREIGN PATENTS OR APPLICATIONS

| | | | |
|---|---|---|---|
| 1,391,985 | 2/1965 | France | 160/135 |

*Primary Examiner*—Price C. Faw, Jr.
*Assistant Examiner*—Carl D. Friedman
*Attorney, Agent, or Firm*—Alan Swabey & Co.

[57] ABSTRACT

An improved space dividing panel and a space dividing assembly incorporating such panels. The panel has means along its bottom edge for use in supporting the panel and separate means on at least one end edge at the top and bottom for use in connecting the panel to another panel. Panels are connected together, at any angle, by simple post units to form space dividing assemblies. The post units comprise a simple tubular member having an adjustable top cap. The connecting means comprise brackets at the top and bottom edges which extend past the end of the panel and are insertable into the interior of the tubular posts. The top of each tubular post is adapted to receive a threaded cap member.

13 Claims, 16 Drawing Figures

A
B
C
D
7
17
21
23
25
27
29
31
33
41
43
45
47
48
49
51
53
53a
55
57
61
63
81
83
85
87
89
15a

FIG. 13a
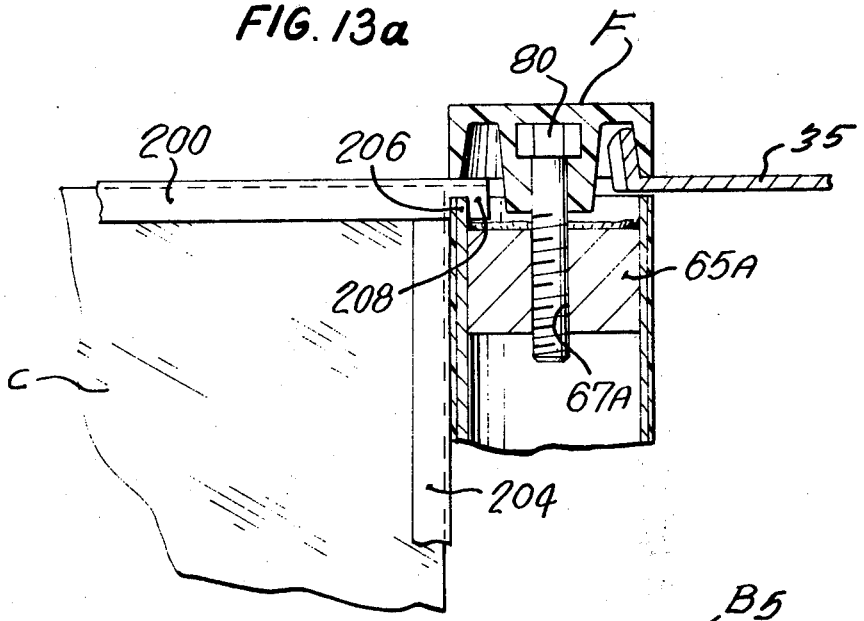
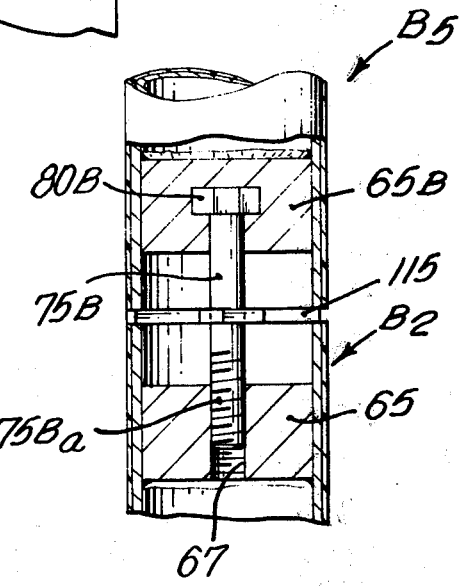
FIG. 14
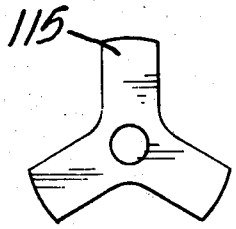
FIG. 15

DIVIDER SCREEN ASSEMBLY

BACKGROUND OF THE INVENTION

1. Field of the Invention

This invention is directed towards improvements in space-dividing panels, and to space-dividing assemblies using the panels.

More specifically, the invention relates to a panel and post construction in which an array of acoustical panels and vertical connecting posts make up space-dividing units of variable size and arrangement.

2. Description of the Prior Art

Most such panel units use relatively complicated and expensive connecting means. Some embody basic support means in the posts, which further complicates the structure. It is an aim of the present invention to provide panel units with simpler connecting means and other structural and operational advantages as will be explained.

SUMMARY OF THE INVENTION

The invention is embodied in the type of space-dividing unit in which there is an array of at least two acoustical panels intervened by a common connecting post. A panel according to the invention has horizontal top and bottom edges and extending between them a vertical seating edge designed to abut the post.

The panel and post are provided with cooperating adjustable securing means for connecting the panel and post and urging them against each other. The securing means includes upper and lower members on the panel which are clamped under screw pressure into upper and lower engagement with the post which, preferably, urges the post inwards against the edge of the panel is a snug fit. The post has a tubular wall and is open at the bottom and provided at the top with an adapter having a downwardly extending wall aligned with that of the post. Connector hook parts project from the panel to engage, respectively, the bottom of the post wall and the wall of the adapter.

In a preferred structure, a panel-mounted lower bracket protrudes beyond the seating edge of the panel and has a terminal upwardly extending lower hook to engage the lower end of the tube wall. A panel-mounted upper bracket protrudes from the seating edge at an upper position and has a terminal upwardly extending upper hook for engaging and receiving downward pressure from the wall of the adapter. One or both hooks are preferably angled to exert an inward wedging action on the tube wall as the tube is pressed between the respective hooks.

A preferred adapter includes a securing cap of integral structure including a symmetrical body having a disc-like crown. A frusto-conical boss protrudes centrally from the crown and tapers from a root to a thinner tip. An annular flange or skirt extends from the margin of the crown at a position spaced outwardly from the root of the boss. The skirt has an outside cylindrical face which forms a continuation of the crown and an inside frusto-conical face sloping outwards from the crown. The boss protrudes beyond the skirt, with the flange and boss forming between them an annular recess for receiving the upper hook. A threaded shank protrudes from the tip of the boss for screwable engagement with a threaded plug fixed in the top of the post.

Each panel is preferably supported by a special bracket according to the invention. This hardware has a bar or bracket mountable on the bottom edge of the panel and which ends in a lower connecting hook, as described earlier. Spaced from the hook is an access opening in the bar. Surrounding the opening and welded to the upper side of the bar is a perpendicularly extending housing tube containing an adapter sleeve secured to the tube, for example by a weld. The opening in the bar and sleeve form a socket for the shaft of a supporting member. The opening in the bar or the socket or both are tapped to receive the threaded shaft of the supporting member, for example a glide or other type of support.

The bar is mounted on the bottom edge of the frame of the panel with its tube extending into an opening provided in the panel frame. The supporting member is then adjustably connected to the bottom of the panel by screwing its shaft into the tapped socket.

The panel and post construction of the invention also lends itself to carrying accessories. For example, the panel wall may be provided with in-built tapped sockets for connecting screws for holding a shelf-supporting bracket. A housing for wiring may be conveniently mounted on the bottom margin of the panel to receive wiring, which continues up through the open bottom end of the post to a convenient outlet higher up. This housing may take the form of a channel member having resilient walls for engaging the sides of the panels. In this way a wiring passage is formed between the bottom edge of the panel and the web of the channel.

BRIEF DESCRIPTION OF THE DRAWINGS

The invention will now be described in detail having reference to the accompanying drawings, in which:

FIG. 13*a* is a fragmentary side elevation, partly in section, showing the connection of a top pane as shown more generally in FIG. 1 (left hand panel);

FIG. 14 shows the top of a main post, in section, and an extension post, partly in section, to illustrate connection means for the posts and for an extension member; and FIG. 15 illustrates a type of washer used in the connection in FIG. 14.

DESCRIPTION OF THE PREFERRED EMBODIMENTS

Figure 1:
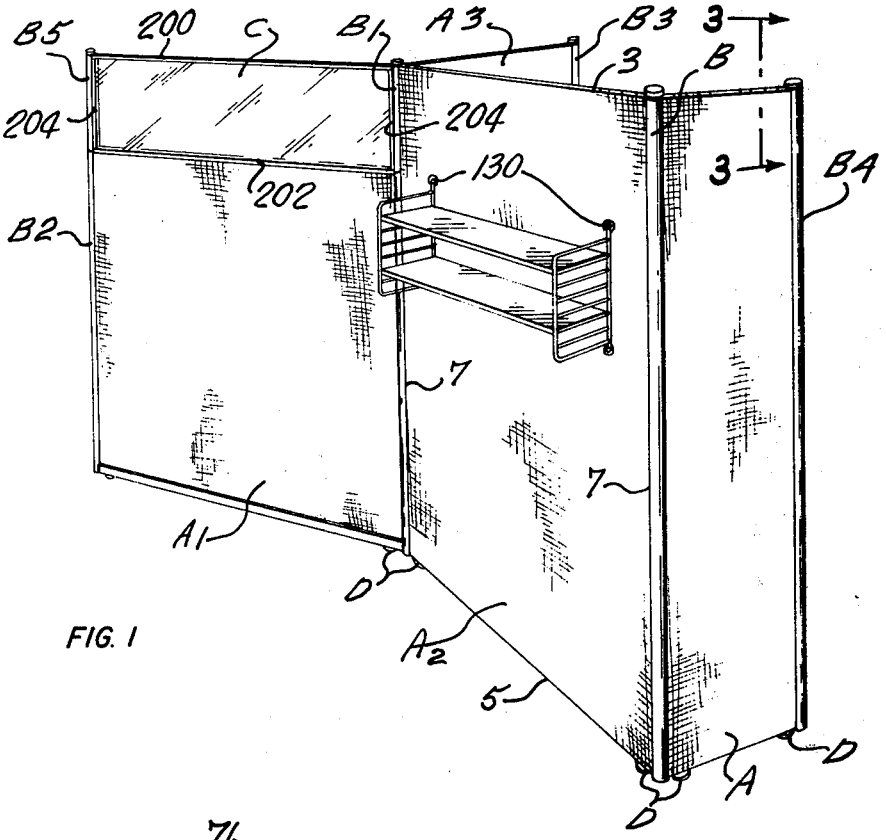
FIG. 1 is a perspective view of a space-dividing assembly according to the present invention.
Figure 2:
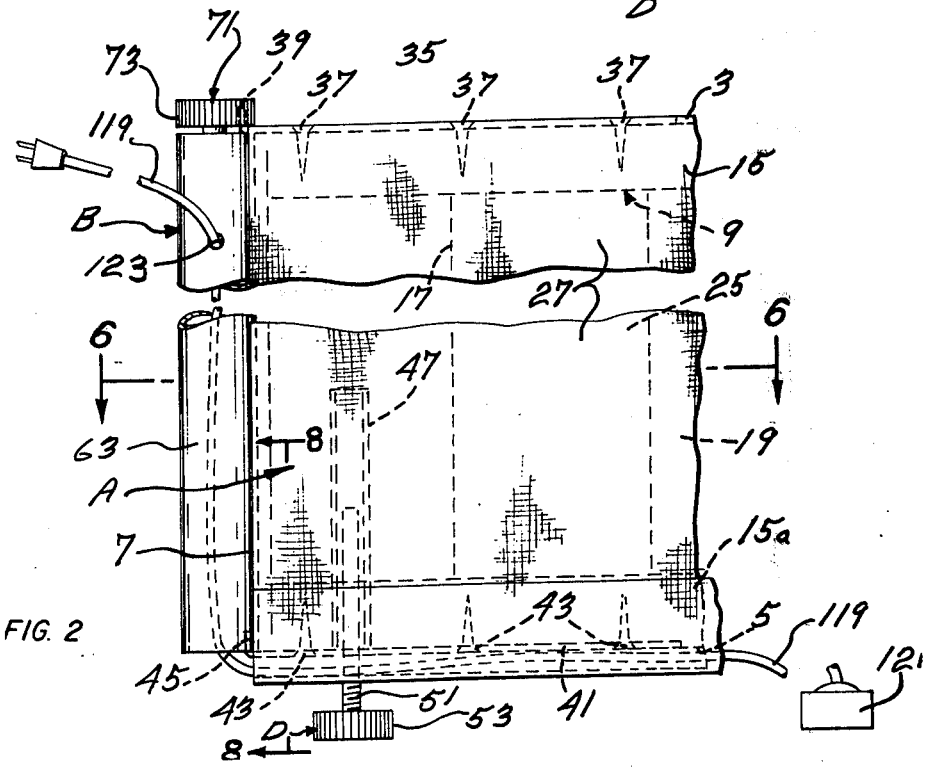
FIG. 2 is a partial front elevation of one of the panels used in the assembly of FIG. 1.

A space-dividing assembly, according to the present invention, is shown generally in FIG. 1. The assembly comprises an array of space-dividing panels A, $A_1$, $A_2$, $A_3$. These panels are shown connected to one another along their end edges by tubular posts B and $B_1$. The three panels $A_1$, $A_2$ and $A_3$ are connected to the post $B_1$, while two panels A, $A_2$ are connected to post B. The panels and posts are constructed so that up to four panels may be connected to each post. The panels may be connected to each other, via the tubular post, at different angles. The free ends of any panels, such as panels $A_1$, $A_2$ and $A_3$ terminate in tubular posts $B_2$, $B_3$ and $B_4$, to provide a finished and balanced appearance. These posts are optional.

The panels in the assembly may be of the same size and construction. Alternatively, one panel, for example the panel $A_1$ as shown, can be shorter than the others. This panel $A_1$ can be topped with an extension in the form of a pane C. This may be opaque or of transparent or translucent material for example a sheet of glass or plastic material. The pane C nests on the top edge of panel $A_1$ and is connected, by suitable means (described later) to posts $B_1$ and $B_5$. Post $B_5$ is an extension of post $B_2$.

Each panel is provided with supports D, adjacent each end edge. The supports D are separate from the posts B, $B_1$, etc.

Each panel A, $A_1$, etc., as shown in detail in FIGS. 2 to 6, preferably is rectangular in shape and has a top edge 3, a bottom edge 5 and end edges 7. Each panel has a frame 9, preferably of wood. The frame 9 has upper and lower rails or beams 15 and 15*a*, and end posts or columns 17. Intermediate posts or columns 19 are provided between the posts 17. Partition members 21, made of relatively thin solid, rigid material, for example the board sold under the trade mark "Masonite", are connected to the center of the beams and columns and fill the areas between the beams and columns. A thin outer sheet 23 of fire-retardant material, for example polyurethane foam covers each side of the panel, extending over, and attached to, by suitable means, for example adhesive, the columns and beams. The spaces between the sheets 23 and partitions 21 are filled with an insulating material 25, for example glass fiber. An outer skin of decorative resilient fabric 27 which can be of any color or combination of colors is stretched over the outer sheet 23 on each side of the panel.

The edges of the fabric 27 on each side are stretched over the edges of the panel and into a central recess 29 which extends about the peripheral edge of the panel. The edges are secured to the frame by suitable means, for example staples 31. A double seam piping 33 is adhesively secured in the recess 29 to hide the edges of the fabric 27 and provide a trim giving a finished appearance to the edge of the panel. The construction described provides a panel which has good sound-deadening properties, is simple to construct, and which has a pleasing appearance which can be varied widely by coice of covering fabric.

Figures 3, 4, 6:
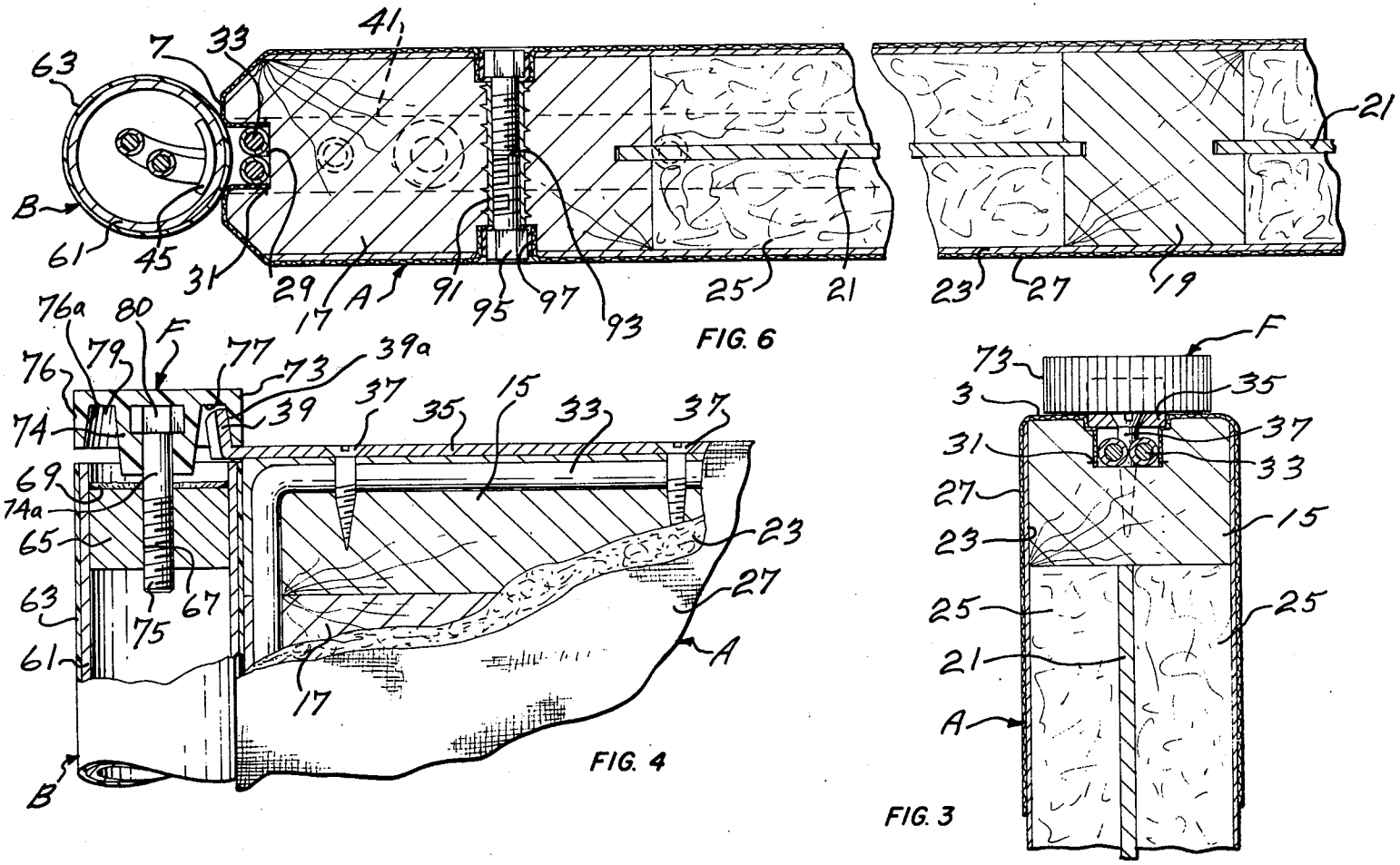
FIG. 3 is a fragmentary cross-section of the panel at a top corner, along line 3—3 of FIG. 2.
FIG. 4 is a fragmentary front elevation, partly in cross-section, of the panel at a top corner.
FIG. 6 (appearing on the sheet with FIGS. 3 and 4) is a fragmentary cross-section along line 6—6 of FIG. 2.

Each panel is provided with connecting means at the top and bottom of each end edge 7 for use in connecting the panel to another panel. The connecting means at the top includes a bracket 35 attached to the top of beam 15 by screws 37, as best seen in FIG. 4. The bracket 35 projects slightly past end edge 7 and has an upturned flange or lug 39. In its preferred form the lug 39 is specially formed to present an arcuate surface 39*a* for engagement with the inner surface of a connecting member and is angled outward between about 3° and about 5°, desirably about 4° from a line perpendicular to the body of the bracket 35. The connecting means at the bottom, best seen in FIG. 5, comprises a bracket 41 which is attached to the bottom of beam 15*a* by screws 43. The bracket 41 also projects slightly past end edge 7 and has an upturned flange or lug 45. The lug 45, like the lug 39, and has an inner arcuate surface for engagement with the inside of the bottom of the connecting post and is also angled outward between 3 and 5°, desirably about 4°.

Supporting means are also provided in each panel at the bottom edge 5 for use in supporting the panel. These means comprise a tube or pipe 47 mounted adjacent each end edge 7 in each panel and extending up into a recess 48 through the rail 15a and the end post 17 of the frame 9 from bottom edge 5. The pipe 47 is welded to the bracket 41 as at 55. A threaded sleeve or socket 49 is contained in the lower end of the pipe 47 and tacked to it by welding to prevent rotation. The bracket 41, pipe 47 and sleeve 49 may be made up as a prefabricated unit ready for mounting on the panel.

A support member D for the panel is mounted within each socket. The support member D, seen in FIGS. 5, 10 and 11, preferably comprises a glide having a threaded shaft 51 extending up from the center of a thin base disc 53. The shaft 51 is threaded into the sleeve 49. The side of the disc 53 is preferably knurled as at 53*a* to facilitate screwing the support member D into the socket. No tools are required for this operation.

The bracket 41 has a through hole 57 aligned with the bore of the sleeve 49. When assembling the panel, the tube 47 is pushed into recess 48 and maintained in place when bracket 41 is attached to the panel by screws 43.

Figures 5, 7:
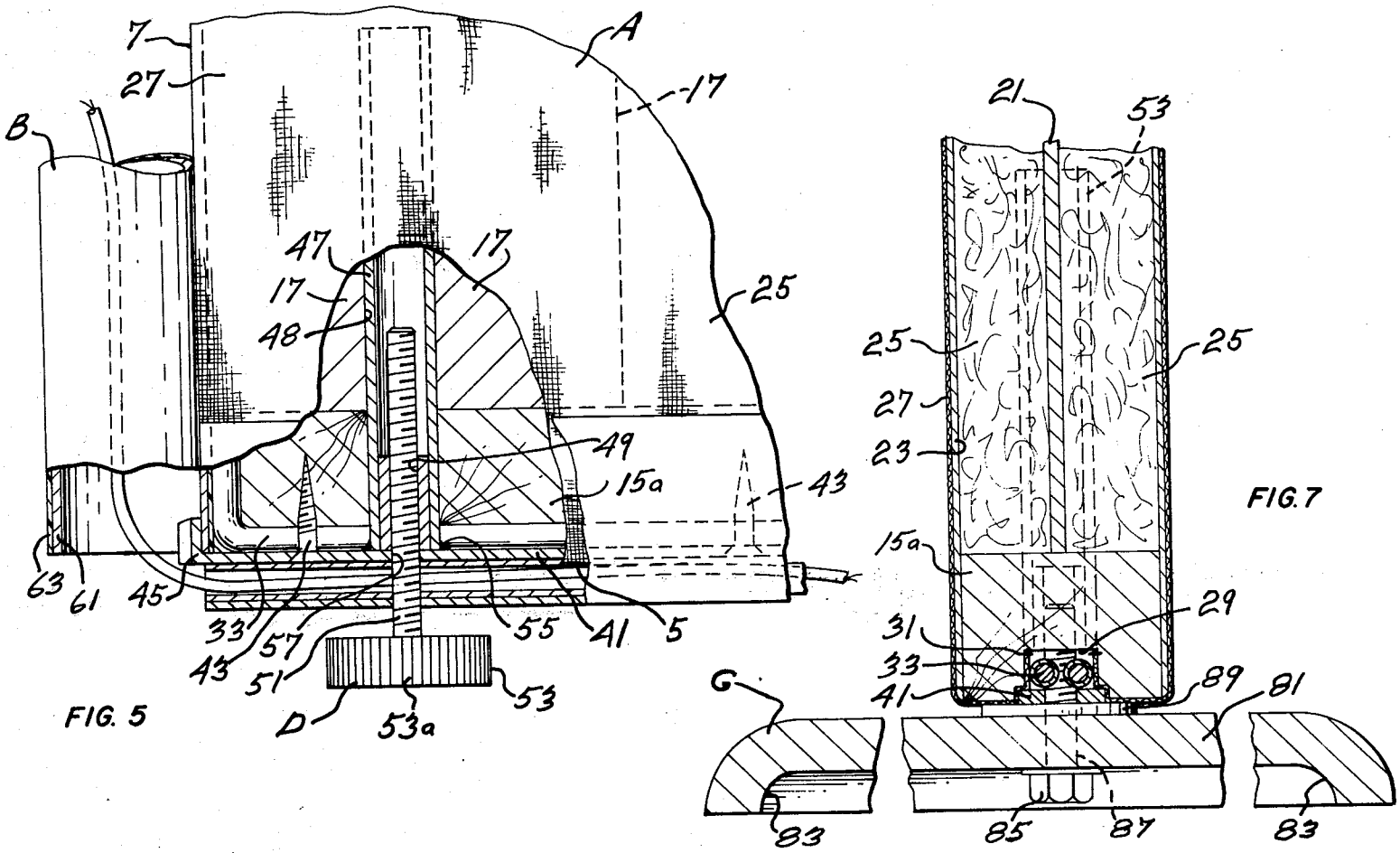
FIG. 5 is a fragmentary front elevation, partly in cross-section, of the panel at a bottom corner.
FIG. 7 (appearing on the sheet with FIG. 5) is a fragmentary cross-section of the panel showing an alternative type of support.

The tubular posts B, $B_1$, etc. for connecting the panels together each include an elongated tube 61, seen in FIGS. 4 and 5, preferably made of metal, conveniently steel, and having a length substantially equal to the length of edge 7. The tubular member 61 may be and is preferably covered with a thin decorative plastic tight fitting sleeve 63.

Mounted within the tube 61, adjacent its top end is a plug 65 having a central threaded bore 67. The plug 65 is attached to the tube 61 by a weld 69. The post unit includes a cap F, seen in FIGS. 4 and 9, comprising a thin, cylindrical disc-like head or body 73 having a central boss 74 from which extends a threaded shank or shaft 75. An annular flange 76 extends from the edge of the head 73 to provide with the boss 74 an annular groove 79. The cap F is attached to member 61 by threading its shaft 75 into the bore 67 in the plug 65.

Figure 9:
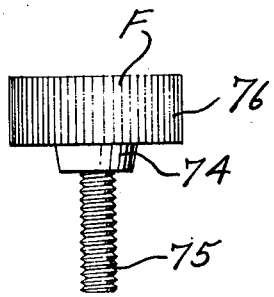
FIG. 9 is a side elevation of a preferred form of connecting cap.

Preferred results are obtained with a cap F of special construction as shown in FIG. 9 and in cross-section in FIG. 4. In this construction, the body 73, the frustoconical boss 74 and the annular flange or skirt 76 are made of a moldable plastic material and the shaft 75 of metal. The shaft 75 is actually part of a bolt which has a head 80, an unthreaded shank part within, and protruding slightly from the boss 74*a*, and a threaded terminal part 75*a*. The body 73, the boss 74 and the flange 76 are molded integrally about the bolt.

Preferably the boss 74 projects beyond the flange 76. The protruding part of the boss 74 reinforces the shank 75 against distortion under lateral tension caused by the outward resultant force acting on the cap F as it is screwed downwards. Desirably the boss 74 tapers between 3 and 5° from the axis of the shaft 75. Preferably, also the inner face 76*a* of the flange 76 slopes outwards between 4 and 5 degrees from the axis of the shaft 75. An ideal angle for the boss and flange is 4°. It is also desirable that the part of the cap F between the inner face 76*a* and the face of the boss 74 and the underside of the disc 73 respectively be radiused for strength. it is also desirable that the junction between the annular face 76*a* and the lower edge of the flange or skirt 76 be radiused to facilitate initial contact between the cap F and the lug 39.

Figure 10:
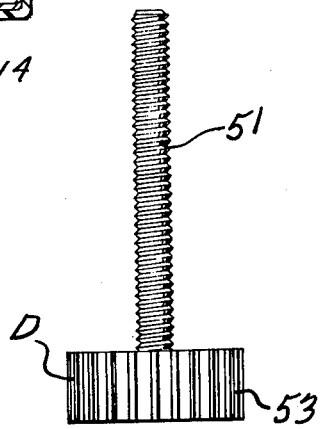
FIG. 10 is a side elevation of a preferred form of supporting foot.
Figure 11:
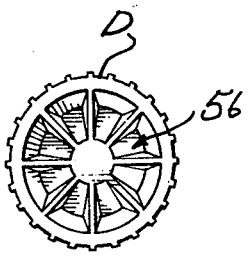
FIG. 11 is a bottom view of the foot shown in FIG. 10.

The supporting unit D shown in FIGS. 5, 10 and 11 is made similarly to the connecting unit F. The body or glide of the unit is molded about the head of a bolt from which the shank 51 projects as shown. The body is made of plastic material and is provided in its base with recesses 56 for economy of material. Its outer surface 53*a* is preferably provided with knurling or ribbing.

Two panels A, $A_1$ are connected together by a post unit B. The unit B, or more precisely the tube 61, is first slipped over the upturned flange 45 of the bottom bracket 41 on a panel. The cap F at this time is removed, or fully extended. The lower end of the wall of the tube 61 sits on the bracket 41 at its bottom end and its top end just fits under the lug 39 of a top bracket 35. The tubular member 61 bears firmly against the corners of recess 29. The cap F is then screwed down engaging lug 39 of the top brackets in groove 79. The dimensions of the respective parts are such that the tube 61 fits snugly against the resilient upholstering material at the edges of the recess 29. The resilience of the material at the narrow edges of the recess 29 makes for a snug fit. When the cap F is screwed down its inclined face 76*a* bears against the inclined face of the lug 39 of the connecting bracket 35 to cause a wedging or camming action drawing the tube 61 towards the edge of the panel. It is desirable that the cap F be screwed in by hand rather than using a tool since it should not be screwed in too tightly or else there is distortion. It will be seen that two, three or four panels can be quickly connected together, at any angle, by a single, simple, inexpensive post unit.

In a preferred construction, the length of the post B relative to the spacing of the brackets 35 and 41 is important. This length should be such that when the bottom of the wall of the post B seats on the bracket 41 its top wall fits underneath the bracket 35. The action of pushing the post B down with its wall between the lug 45 and the edge 7 of the panel A forces the wall of the post in against the edge 7 because of the angle of the lug 45. The position of the lug 45 should be such that the post B is drawn close to the edge 7. When the cap F is screwed down into the plug 65 its annular sloping face 76*a* engages the lug 39. As the cap F moves downward it is cammed inward by the lug 39 so as to pull the top end of the post B into contact with the edge 7. As mentioned, it is desirable that the cap F be turned by hand rather than with the use of tools since overscrewing the shaft 75 into plug 65 will cause distortion. With the cap F screwed down the post B will be in close contact with the edge 7 resting against the upholstery on the edge of the recess 29 and preventing any gap between post B and its point of contact with the edge 7.

If desired, as shown in FIG. 7, each support glide D for the panels can be readily replaced by a foot member G. The member G comprises a wide base 81 having down-turned ends 83 forming feet. The base 81 is connected to the panel by bolt 85, passing through a hole 87 in the base and a washer 89, to be threaded in the tube 47.

Means can be provided in one or both of the side faces of the panel for use in attaching shelves or other furniture members to the panels. These means, shown in FIG. 6, can comprise sockets 91 threaded into blind holes 93 on the columns or beams extending in from the side faces of the panels. A cap screw 95 screws into hole 93, flush with the panel to hold a portion 97 of the member to be attached.

Figure 12:
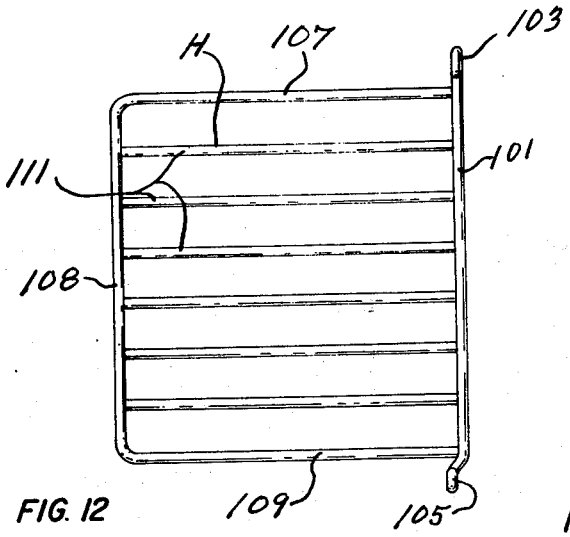
FIG. 12 is a side elevation of a preferred form of shelf-supporting racket.
Figure 13:
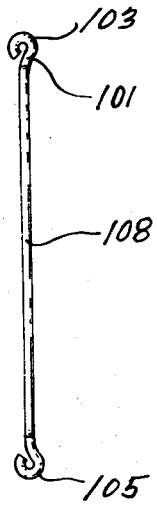
FIG. 13 is an end elevation of the bracket shown in FIG. 12.

A preferred device for attaching shelves is shown in FIGS. 12 and 13. In its preferred form this is a wire bracket having an upright spine 101 provided at top and bottom ends with engagement means 103 and 105 respectively. A loop extends from the spine 101 made up of an upper arm 107, a downwardly extending ligament 108 and a lower arm 109. Between the arms 107 and 109 are a plurality of intermediate arms 111 extending between the spine 101 and ligament 108 each adapted to receive a shelf supporting member. Preferably, the arms 107, 109 and 111 are angled slightly upwardly to allow for downward droop of the bracket H so the arms will remain substantially horizontal under load. The device may be of welded construction if of metal, or molded, if of plastic.

The attaching means are held on the panel by protrusions 130, seen in FIG. 1, which engage the loops 103 and 105. The protrusions may be bolts extending from sockets as shown in FIG. 6.

Figure 8:
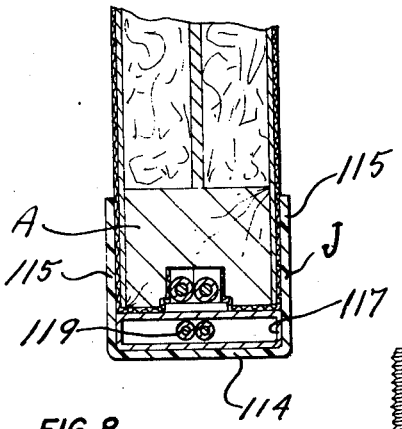
FIG. 8 is a fragmentary vertical cross-section along the line8—8 of FIG. 2.

The construction of the invention also lends itself to the convenient application of electrical or other services. See specially FIGS. 2 and 8. There is shown applied to the bottom of the panel A a resilient channel member J which has a base 114 and resiliently related walls 115 which engage the sides of the panel A in a push fit. Retained by the channel J is a rectangular cross-section tube 117 which carries electric wiring 119. This wiring extends from a floor plug 121 and through the tube 117 then up through the post B and out through an outlet opening 123. The tube 117 is preferably of metal while the channel J is preferably of plastic material, for example polyvinylchloride.

A means for mounting an extension C on a panel $A_1$ will be described with reference to FIGS. 1, 14 and 15. As seen in FIG. 14, the top of the post $B_2$ comprises, as above-described, a plug 65 with a central threaded bore 67. In a like manner, the top of the post $B_5$ also has a plug 65A with a central threaded bore 67A, and the bottom of the post $B_5$ has a plug 65B. Mounted in plug 65B is a bolt with a head 80B and a shank 75B including a threaded portion 75B*a*. Washer 115, shown in detail in FIG. 15, is disjoined between $B_2$ and $B_5$.

To mount $B_5$ on $B_2$, the washer 115 is mounted at the top of $B_2$, and shank 75B is inserted, through the central opening in the washer, into the threaded bore 67 of the plug 65. $B_5$ is then rotated manually to thread the threaded portion 75B*a* into the thread 67 of plug 65. The post $B_5$ is rotated to a relatively tight fit.

The extension C comprises a frame with a top member 200, a bottom member 202 and side members 204 (see FIGS. 1 and 14). The top member includes a groove 206 between the main body of the member and flange 208. The groove 206 is wide enough to receive the top wall of post $B_5$.

To mount the extension C, cap F is either removed or placed in an extended position. Groove 206 is disjoined on the wall of $B_5$, and cap F is rotated to engage bracket 35 as above-described. When cap F is in tight engagement, the bottom of the cap holdingly engages the top of member 200 to hold the extension C in place.

We claim:

1. A space dividing assembly comprising at least two space dividing panels, each panel having end edges and top and bottom edges, means in each panel at the bottom edge for use in supporting the panel, and means in each panel at the top and bottom of at least one end edge for use in connecting the panel to another panel, a tubular post unit, the tubular post unit located between the two panels with the connecting means on each panel releasably connected to the tubular post unit, the connecting means urging the panels snugly against the tubular post unit, the means for supporting the panel permitting the panel to be situated in an upright position before connecting the panel to the tubular post unit, thereby facilitating erection and dismantling thereof, and wherein the means for use in connecting each panel to another panel comprise a pair of brackets, one bracket attached to the bottom edge, the other bracket attached to the top edge, both brackets projecting slightly past the one end edge and having an upturned end, and wherein the tubular post unit comprises a tubular member, a cap threadably connected to the top end of the tubular member, the cap having an annular groove in its bottom surface facing the top of the tubular member, the upturned end of the one bracket extending up into the tubular member from the bottom end of the tubular member, the upturned end of the other bracket extending over the top end of the tubular member and up into the groove in the cap, a symmetrical body having a disc-like base terminating in a circular edge, a frusto-conical boss protruding centrally from said base and tapering inwards from a root to a thinner tip, an annular flange protruding from the edge of the base at a position spaced from the root of the boss and having an outside cylindrical face forming a continuation of said base and an inside frusto-conical face sloping outwards from the base, the boss protruding beyond the flange and the flange and boss forming between them the annular groove for receiving a connecting flange of a panel bracket, and a threaded shank protruding from the tip of the boss for screwable engagement with a securing member on the top of the post.

2. A space dividing assembly as claimed in claim 1, wherein the means for use in supporting each panel comprise a socket adjacent each end edge, extending up from the bottom edge for receiving a supporting member.

3. A space dividing assembly as claimed in claim 2, wherein each socket is connected to the bracket at each bottom end of the panel.

4. A space dividing assembly as claimed in claim 3, including means in at least one face of the panel adjacent its end for use in attaching a furniture element to the panel.

5. A space dividing assembly as claimed in claim 3, and including a central recess extending around the periphery of the panel, and a double seamed piping adhesively secured in the entire length of said recess.

6. A space dividing assembly in which there is a panel having a vertical seating edge and a cylindrical connecting post abutting thereagainst and cooperating connecting means on the panel and post releasably urging the panel and the post snugly against each other;

wherein said post is a tube having a wall presenting a lower open end and an upper end provided with a fixed adapter having a tapped opening, the cooperating connecting means including a screw cap screwably engaging the adapter and having a downwardly projecting skirt, lower hook means mounted on the panel and protruding beyond the seating edge thereof to engage the lower end of the tube wall and upper hook means mounted on the panel and protruding beyond the seating edge thereof to engage a cooperating surface of the skirt of the cap, the hook means being inclined to provide camming surfaces for urging the wall inwardly against the vertical seating edge.

7. A space dividing assembly as claimed in claim 6, wherein there are at least two such panels and respective connecting means securing them to the post.

8. A space dividing assembly as claimed in claim 6, wherein the lower hook means comprises a lower bracket, including a socket which extends upwards into the panel for receiving a support member.

9. A space dividing assembly as claimed in claim 6, wherein the panel has at least one face equipped with means for attaching a projecting furniture element thereto.

10. A space dividing assembly as claimed in claim 6, wherein the panel includes a recess extending around a periphery of the panel with a double seamed piping adhesively secured in said recess to form a seat for the seating edge of the panel.

11. A space dividing assembly as claimed in claim 6, wherein the lower hook means comprises a lower bracket having an elongated bar for mounting on a bottom edge of the panel and having a hooked end, said bar being provided spaced from said hooked end with an opening, a tubular socket permanently attached to said bar and extending perpendicularly thereto in the direction of said hooked end and surrounding said opening, said socket being tapped to receive the shank of a supporting foot.

12. A space dividing assembly as claimed in claim 6, wherein an elongated housing for electric wiring is mounted along a bottom margin of the panel, the post is provided at a position remote from its lower open end with an outlet opening, and electric wiring extends through said elongated housing along the bottom of the panel and up through the lower open end of the post and out through said outlet opening.

13. A space dividing assembly as claimed in claim 12, wherein the elongated housing is in the form of a channel having resilient walls retainingly engaging opposed faces of the panel.

* * * * *